United States Patent [19]

Fowler et al.

[11] Patent Number: 4,813,251

[45] Date of Patent: Mar. 21, 1989

[54] FOUR POINT LOCKING SYSTEM FOR STORAGE CABINETS

[75] Inventors: David K. Fowler, Aurora; David E. Story, Chicago, both of Ill.

[73] Assignee: The Marvel Group, Inc., Chicago, Ill.

[21] Appl. No.: 160,748

[22] Filed: Feb. 25, 1988

[51] Int. Cl.[4] ..... E05B 63/14

[52] U.S. Cl. ..... 70/116; 70/82; 292/5; 292/181

[58] Field of Search ..... 70/116, 114, 125, 127, 70/78, 81, 82, 83, 84, DIG. 20; 292/181, 177, 5, 62, 69, 254, DIG. 17, DIG. 69

[56] References Cited

U.S. PATENT DOCUMENTS

| | | | |
|---|---|---|---|
| 2,174,200 | 9/1939 | Boland | 70/DIG. 20 |
| 2,565,711 | 8/1951 | Whalley | 292/181 |
| 3,325,202 | 6/1965 | Mateja | 292/181 |
| 3,589,152 | 6/1971 | Glass et al. . | |
| 3,630,556 | 12/1971 | Bertellotti . | |
| 4,135,375 | 1/1979 | Voegeli . | |
| 4,177,656 | 12/1979 | Davis . | |
| 4,190,273 | 2/1980 | Schaffrin . | |
| 4,226,101 | 10/1980 | Lee . | |
| 4,290,281 | 9/1981 | Knaack et al. . | |
| 4,370,874 | 2/1983 | Munn . | |
| 4,414,828 | 11/1983 | Takinami et al. . | |
| 4,477,130 | 10/1984 | Frantz . | |
| 4,494,781 | 1/1985 | LaFosse . | |
| 4,569,213 | 2/1986 | Seelba . | |
| 4,609,233 | 9/1986 | Walla . | |
| 4,683,736 | 8/1987 | Weinerman et al. . | |

OTHER PUBLICATIONS

Brochure extract–"Monitsa P. C. Work Station", Montisa Office Furniture, Division of Northland Corporation.

"Office Furniture–Systems for your Office Productivity", Borroughs Division, Lear Siegler, Inc., 1983.

*Primary Examiner*—Robert L. Wolfe

*Attorney, Agent, or Firm*—Edgar A. Zarins; Malcolm L. Sutherland; Steven L. Permut

[57] ABSTRACT

A four point locking system for a storage cabinet having a pair of outwardly pivotable doors which provide access to the cabinet interior. The locking system includes a lock bar vertically disposed in each door and adapted to be moved downwardly into the bottom lintel of the cabinet. A plunger bracket is pivotably mounted within the top of the cabinet and includes plunger flanges which move down through the top lintel of the cabinet into each door to lock the top portion of the cabinet doors while simultaneously moving the lock bars downwardly to lock the bottom portion of the cabinet doors. The pivotable movement of the plunger bracket is controlled by a lock push bar which is directly connected to a lock push button extending through the front of the cabinet. An extension spring is utilized to bias the push bar and plunger bracket towards the unlocked position while compression springs attached to the lock bars bias the bars upwardly to their unlocked position. Thus, the doors are locked at both an upper and lower position.

20 Claims, 2 Drawing Sheets

FOUR POINT LOCKING SYSTEM FOR STORAGE CABINETS

BACKGROUND OF THE INVENTION

I. Field of the Invention

This invention relates to a locking system for storage cabinets and, in particular, to a four point locking system which locks the doors at both the top and bottom of the cabinet.

II. Description of the Prior Art

Cabinet locking assemblies are found in many forms and often are dependent upon the operation of the doors, drawers or other closure assemblies. Although it is desirable to lock the cabinet closure in as many positions as possible, cost and mechanical considerations oftentimes limit the locking points. In dual door cabinet constructions, prior known locking systems include a central lock bolt which extends from one door to the other while also possibly extending through a strike plate disposed between the doors. One or both of the doors may be additionally latched to the cabinet structure or the doors may include structure which permits one door to overlap the other door. However, most past known cabinet doors can be dislodged even when locked due to the relative flexibility of the cabinet doors. In addition, it is desirable to control the locking and unlocking of the doors from one button or handle.

SUMMARY OF THE PRESENT INVENTION

The present invention overcomes the disadvantages of the prior known cabinet locking systems by providing a four point locking system which lockingly engages the dual, outwardly pivotable doors of a cabinet at both the upper and lower ends of the doors. The lock mechanism is engageable using a single push-button lock.

The four point locking system of the present invention is adapted for use in storage cabinets having a pair of doors which pivotably or slidably meet along a vertical line, preferably along the center line of the cabinet. The locking system includes a plunger lock button of a well-known type protruding through the top front lintel of the cabinet which controls the locking and unlocking of the cabinet doors. The lock button is connected to a lock push bar which is slidably supported by the mounting bracket for the lock system. A plunger bracket having a pair of plunger arms and a push loop is pivotally mounted to the mounting bracket. The push loop extends substantially downward to engage a lateral slot in the push bar while the plunger arms extend towards the front of the cabinet from the pivot bar of the plunger bracket. The plunger arms include downwardly disposed plunger flanges adapted to extend through aligned apertures in the top lintel and the cabinet doors as the plunger bracket is pivoted to lockingly engage the cabinet doors. An extension spring connected to the plunger bracket and the mounting bracket biases the pivotable plunger bracket towards the unlocked position.

The cabinet doors are provided with lock bars extending the height of the doors and preferably aligned with the center line of the doors. The lock bars include lugs formed at the lower end thereof and a compression spring attached to the lock bar lugs. The lugs are adapted to extend through aligned openings in the bottom of the door and the bottom lintel of the cabinet.

The compression spring is adapted to bias the lock bar upwardly towards its unlocked position.

In order to lock the cabinet once the dual doors are closed, the lock button is depressed until the lock bolt engages into the slot provided on the lock box bracket. As the button is depressed the lock push bar will slide towards the back of the cabinet which in turn will pivot the plunger bracket against the bias of the extension spring. As the plunger bracket pivots, the plunger flanges formed at the end of the two plunger arms will move downwardly first through the respective aperture in the top lintel and through the aperture in the top of the doors. As the flanges enter the top of the cabinet doors they will engage the upper ends of the lock bars, moving the lock bars downwardly to engage the lugs through the bottom of the doors and into the bottom lintel. To release the locking system, the lock button is provided with a key hole utilized to unlatch the lock button. As a result, the extension spring will bias the plunger bracket towards its normal position withdrawing the plunger flanges while simultaneously the compression springs associated with the lock bar lugs will bias the lock bars upwardly, thereby withdrawing the lugs from the bottom lintel. Accordingly, a four point locking system for a dual door storage cabinet is provided to ensure secure closure and locking of the cabinet doors at both the upper and lower ends thereof.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
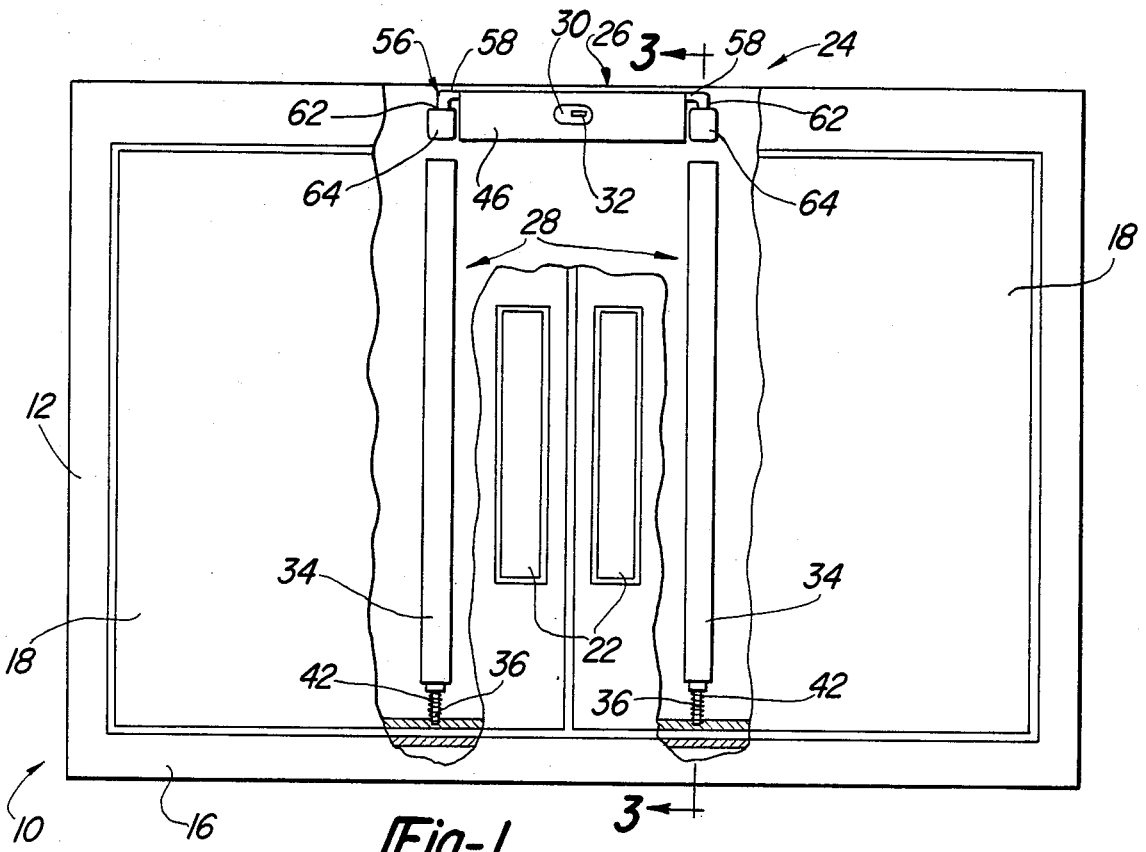
FIG. 1 is a front plan view of a cabinet showing the locking system embodying the present invention in the unlocked position.
Figure 2:
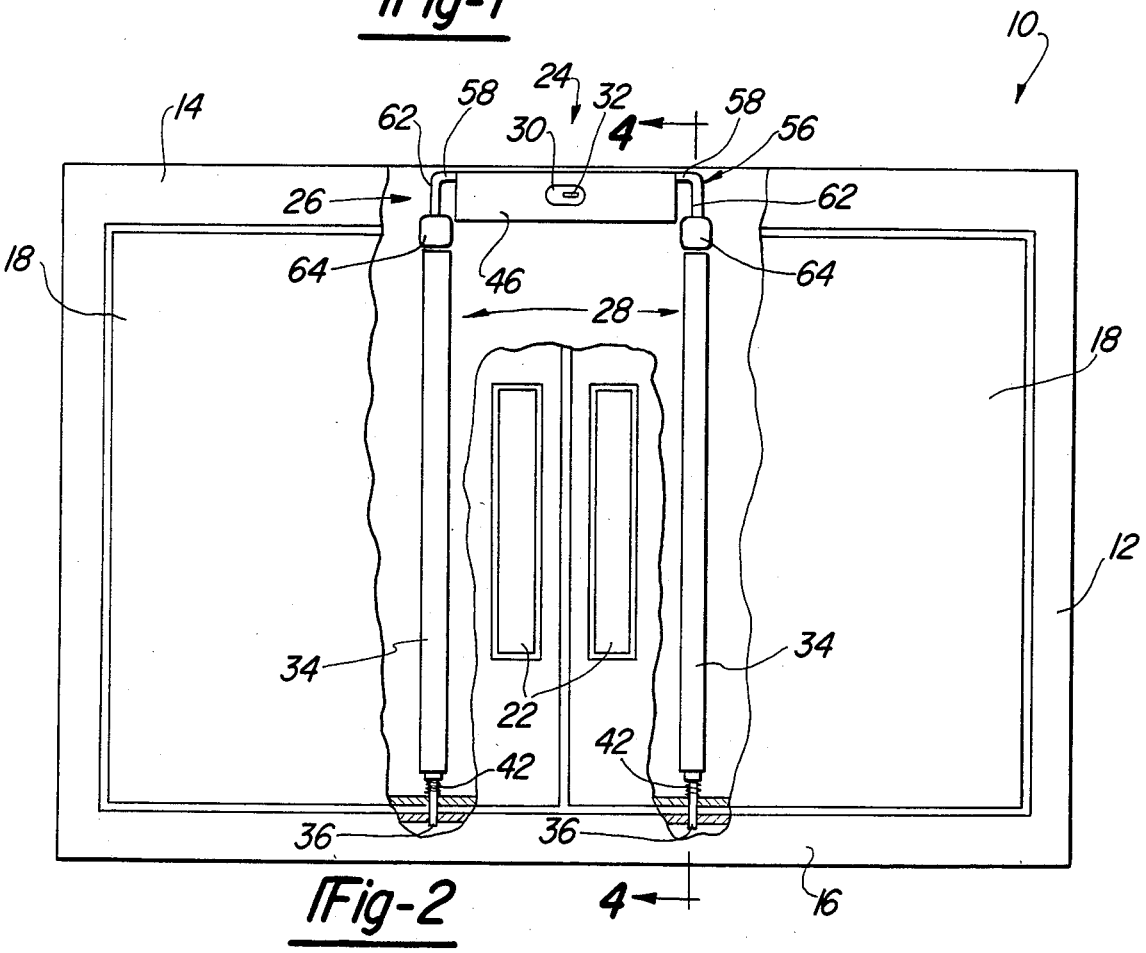
FIG. 2 is a front plan view of a cabinet showing the locking system of the present invention in the locked position.

Referring first to FIGS. 1 and 2, there is shown a storage cabinet 10 having a frame 12, which includes a top lintel 14 and a bottom lintel 16, and a pair of doors 18 to enclose the storage interior 20 of the cabinet 10. The doors 18 are movable between a closed position as shown and an open position to allow access to the interior 20 of the cabinet 10. Handles 22 are preferably provided on the doors 18 to facilitate movement thereof. The present invention will be described in conjunction with pivotable doors 18 as shown in the drawings; however, it should be understood that the invention will operate with other types of doors including tambour-type doors. Moreover, although the present invention will be described herein as positioned within the top lintel 14 of the cabinet 10, it is contemplated that the invention can be positioned elsewhere within the frame 12.

Referring still to FIGS. 1 and 2, which show the front face of the cabinet 10, the locking system 24 of the present invention is shown disposed within the cabinet 10. In a preferred embodiment, the locking system 24 includes an upper assembly 26 disposed within the top lintel 14 and adapted to lock the top portions of the doors 18 against opening, and a lower assembly 28 disposed within the doors 18 and adapted to lock the bottom portions of the doors 18 against opening. The locking system 24 is engaged and disengaged utilizing a single push-button lock 30 preferably mounted within the top lintel 14 and extending forwardly of the front face of the top lintel 14. The lock 30 is of a well-known type which when depressed engages the lock 30. The lock 30 is released using a key within the key hole 32 of the lock button 30. The lock 30 directly affects the locking system 24 of the present invention as will be described in detail herein.

Figure 3:
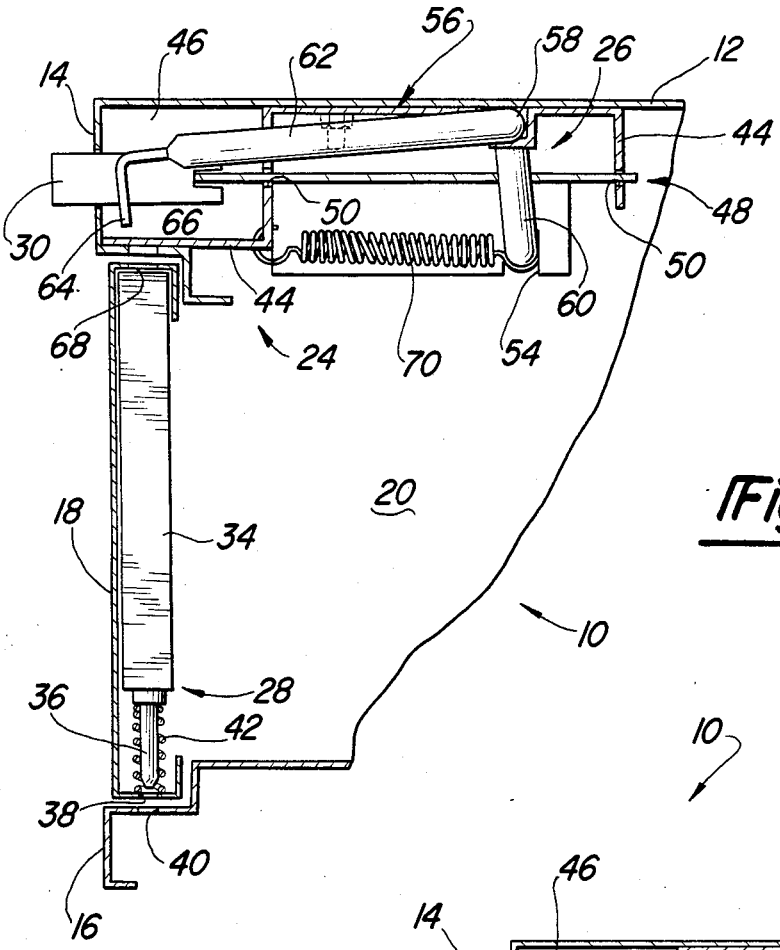
FIG. 3 is a cross-sectional perspective of the locking system in the unlocked position taken along line 3—3 in FIG. 1.
Figure 4:
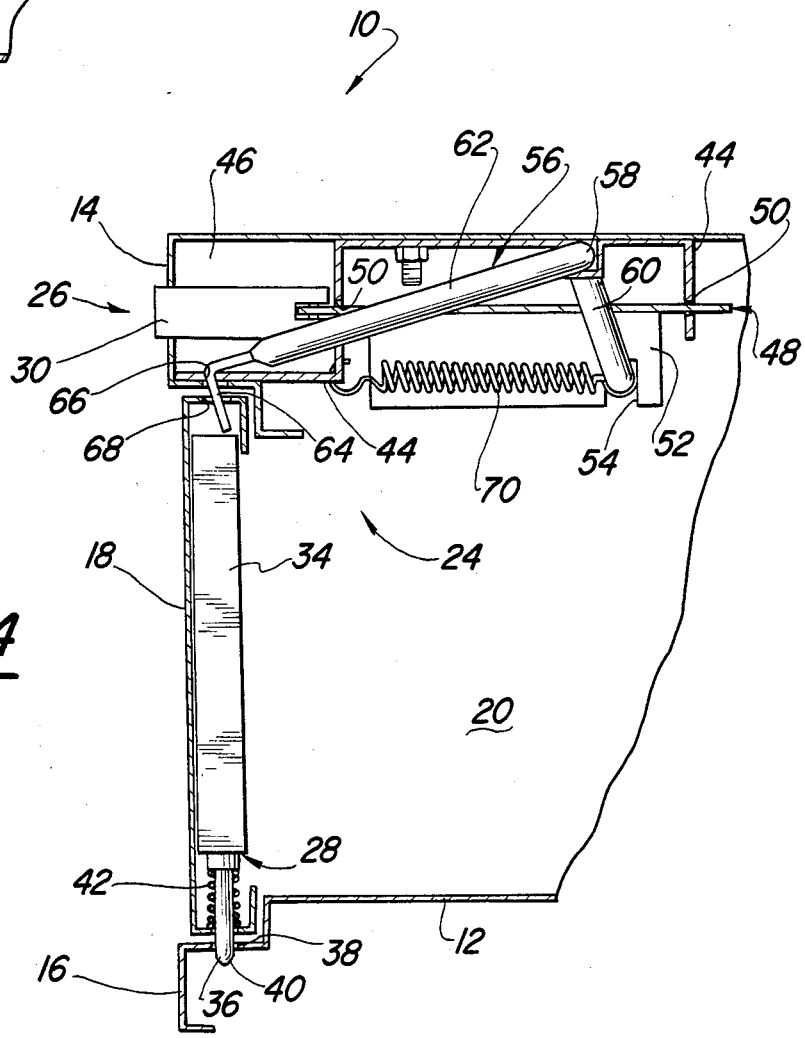
FIG. 4 is a cross-sectional perspective of the locking system in the locked position taken along line 4—4 in FIG. 2.

The lower assembly 28 of the locking system 24 includes a pair of lock bars 34 disposed within the doors 18 substantially parallel to the vertical center line where the doors 18 come together. One lock bar 34 is movably mounted to the interior side of the doors 18 such that the lock bars 34 are free to move in a longitudinal or vertical direction between a retracted position, where the lock bars 34 are fully disposed within the doors 18 as shown in FIGS. 1 and 3, and an extended position wherein the lock bars 34 extend from the doors 18 into the frame 12 of the cabinet 10 as shown in FIGS. 2 and 4. Each of the lock bars 34 is provided with a reduced diameter lug 36 at the lower end thereof which are adapted to extend through aligned apertures 38 and 40 formed in the bottom of the doors 18 and the bottom lintel 16, respectively. The apertures 38 and 40 are brought into alignment when the doors 18 are closed. The lock bars 34 are also provided with compression springs 42 adapted to bias the lock bars 34 toward their retracted positions. The springs 42 are disposed in surrounding relation to the reduced diameter lugs 36 compressible between the bottom of the door 18 and the main portion of the lock bar 34. Accordingly, in the preferred embodiment, the compression springs 42 bias the lock bars 34 upwardly thereby retracting the lugs 36 from the aligned apertures 38 and 40.

Referring now to FIGS. 3 and 4, the upper assembly 26 mounted within the top lintel 14 acts directly upon the lock bars 34 and is actuated by the lock 30. In a preferred embodiment, the upper assembly 26 is maintained within the top lintel 14 by a mounting bracket 44 attached to the cabinet frame 12. The mounting bracket 44 includes structure for retaining the lock box 46 which houses the locking mechanism for the lock 30. The lock push button 30 is directly connected to a push bar 48 which is slidably mounted to the bracket 44. The mounting bracket 44 includes a pair of spaced apart aligned slots 50 adapted to matingly receive opposite ends of the push bar 48. The push bar 48 is aligned with the lock button 30 such that when the button 30 is depressed, the push bar 48 will be moved longitudinally through the slots 50. Similarly, when the lock button 30 is released the push bar 48 will move in an opposite direction. The push bar 48 includes a downwardly depending flange 52 which has a slot 54.

A plunger bracket 56 is pivotably connected to the mounting bracket 44. The plunger bracket 56 includes a lateral pivot bar 58 which is positionally captured by the mounting bracket 44 and about which the plunger bracket 56 pivots. Extending from the pivot bar 58 is a bail member or push loop 60. The bail member 60 is formed perpendicular to the pivot bar 58 and is received within the slot 54 of the push bar 48. The bail member 60 may be any convenient configuration which allows a portion thereof to be received within the slot 54 of the push bar 48 including an inverted T, U-shaped or L-shaped wherein the secondary bar is received by the slot 54.

Extending from opposite ends of the pivot bar 58 substantially perpendicular thereto are a pair of plunger arms 62. Preferably, the plunger arms 62 extend toward the front of the cabinet 10 at a right angle to the bail member 60. Formed at the ends of the plunger arms 62 are plunger flanges 64. The flanges 64 have an angular configuration directed downwardly towards the doors 18. The flanges 64 are adapted to extend through aligned apertures 66 and 68 formed in the top lintel 14 and the upper end of the doors 18, respectively, in order to lock the doors 18 in their closed position. In addition, the apertures 66 and 68 are aligned with the upper end of the lock bars 34 such that the plunger flanges 64 will engage a corresponding lock bar 34 as will be subsequently described.

Referring still to FIGS. 3 and 4, the plunger bracket 56 is adapted to pivot between a retracted position (FIG. 3) and an extended position (FIG. 4) in conjunction with the longitudinal movement of the push bar 48. As the push bar 48 moves through the slots 50, the slot 54 in the push bar 48 will simultaneously move the bail member 60 causing the plunger bracket 56 to pivot about the pivot bar 58. An extension spring 70 connected at one end to the mounting bracket 44 and at its other end to the bail member 60 will bias the plunger bracket 56 towards the retracted position. Alternatively, the extension spring 70 can be connected between the mounting bracket 44 and the push bar 48 to bias the assembly 26.

Operation of the locking system 24 of the present invention provides four point locking of the dual cabinet doors. With the doors 18 closed, the locking system 24 can be actuated using the push button lock 30. As the lock 30 is depressed, the push bar 48 will move longidinally through the slots 50 of the mounting bracket 44. Longitudinal movement of the push bar 48 will cause the bail member 60 to move towards the back of the cabinet 10 thereby pivoting the plunger bracket 56 about the pivot bar 58. The pivoting movement of the plunger bracket 56 will cause the plunger arms 62 and plunger flanges 64 to move from the at-rest retracted position (FIGS. 1 and 3) towards the extended position (FIGS. 2 and 4). The plunger flanges 64, in turn, will extend through the apertures 66 in the top lintel and the apertures 68 in the doors 18 to engage the upper end of the lock bars 34. As the plunger bracket 56 continues to pivot towards the extended position, the plunger flanges 64 will force the lock bars 34 downwardly causing the lugs 36 to extend through apertures 38 and 40 into the bottom lintel 16. When the lock button 30 becomes fully depressed (FIG. 4), the locking mechanism 46 will lock it in position thereby maintaining the plunger bracket 56 and the lock bars 34 in their extended positions. As a result, the plunger flanges 64 and the lock bar lugs 36 will prevent opening of the doors 18. With the plunger flanges 64 extended through the top apertures 66 and 68, the tops of the doors 18 will be locked in place. Likewise, with the lugs 36 extended through the bottom apertures 38 and 40, the bottoms of the doors 18 will be locked in place.

In order to unlock the doors 18 in the preferred embodiment, a key is inserted into the pushbuttom lock 30 to disengage the locking mechanism thereof which causes the button 30 to extend from the top lintel 14. Simultaneously, the push bar 48 will move towards the front of the cabinet 10 causing the plunger bracket 56 to pivot towards its retracted position (FIGS. 1 and 3). The extension spring 70 facilitates retraction by biasing the plunger bracket towards the retracted position. In this manner, the plunger flanges 64 will be retracted from the apertures 68 in the tops of the doors 18 and the apertures 66 thereby freeing the upper end of the doors 18. At the same time, compression springs 42 will force the lock bars 34 upwardly thereby retracting the lugs 32 from the bottom lintel 16 to free the lower end of the doors 18. The doors 18 are now free to be selectively opened and closed as necessary. Thus, the present invention provides a convenient yet secure system for locking the doors of a storage cabinet.

The foregoing detailed description has been given for clearness of understandingly only and no unnecessary limitations should be understood therefrom as some modifications will be obvious to those skilled in the art without departing from the scope and spirit of the appended claims.

We claim:

1. A locking system for a cabinet having a pair of doors movable between an open position and a closed position, the cabinet including a frame in proximate relation to the doors in at least the closed position, said locking system comprising:

a pair of lock bars, one of said lock bars movably mounted to each door, said lock bars selectively movable between a retracted position and an extended position wherein said lock bars extend from the doors into the cabinet frame;

a plunger bracket pivotably attached to the cabinet, said plunger bracket including a pair of plunger arms, each of said plunger arms selectively engageable with a corresponding lock bar, said plunger bracket selectively movable between a retracted position and an extended position wherein said plunger arms extend into the cabinet doors to engage the corresponding lock bar; and means for selectively moving said plunger bracket and said lock bars between said retracted positions wherein the doors are movable to the open position and said extended positions to lock the doors in the closed position.

2. The locking system as defined in claim and further comprising means for biasing said plunger bracket and said lock bars towards said retracted positions.

3. The locking system as defined in claim 2 wherein said biasing means comprises an extension spring connected to said plunger bracket for biasing said plunger bracket towards said retracted position and compression springs attached to said lock bars for biasing said lock bars towards said retracted position.

4. The locking system as defined in claim 3 wherein said plunger bracket includes a pivot bar rotatably attached to the cabinet, said plunger arms extending substantially perpendicular from the ends of said pivot bar, and a bail member extending substantially perpendicular to said pivot bar, said plunger bracket pivoting about said pivot bar.

5. The locking system as defined in claim 4 and further comprising a mounting bracket for securing said plunger bracket and said moving means to the cabinet, said mounting bracket rotatably retaining said pivot bar of said plunger bracket.

6. The locking system as defined in claim 5 wherein said plunger arms of said plunger bracket include plunger flanges formed at the remote ends thereof, said plunger flanges formed at an angle to said plunger arms and adapted to extend into the cabinet doors to engage a corresponding lock bar disposed in the doors to move said lock bars to their extended position as said plunger bracket moves to the extended position.

7. The locking system as defined in claim 6 wherein said means for moving comprises a push bar movably attached to said mounting bracket, said push bar including means for receiving said bail member of said plunger bracket whereby said plunger bracket is pivotably moved as said push bar is moved longitudinally.

8. The locking system as defined in claim 7 wherein said mounting bracket includes at least one receiving slot adapted to movably receive said push bar.

9. The locking system as defined in claim 7 wherein said extension spring is connected at a first end to said mounting bracket and at a second end to said bail member of said plunger bracket.

10. The locking system as defined in claim 7 and further comprising manually engageable lock means connected to said push bar and extending exteriorly of the cabinet frame, said lock means being longitudinally movable to an engaged position thereby longitudinally moving said push bar to move said plunger bracket and lock bars to their extended position and said lock means being longitudinally movable to a disengaged position thereby longitudinally moving said push bar to move said plunger bracket and lock bars to their retracted positions.

11. A locking system for a cabinet having a pair of doors movable between an open position and a closed position, the cabinet including a frame with a top lintel disposed above the doors in their closed position and a bottom lintel disposed below the doors in their closed position, said locking system comprising:

a pair of elongated lock bars, one of said lock bars movably disposed within each door, said lock bars selectively movable between a retracted position and an extended position wherein said lock bars extend from the doors into the bottom lintel;

a plunger bracket pivotably attached to the cabinet frame, said plunger bracket including a pair of plunger arms, each of said plunger arms being selectively engageable with one of said lock bars when the doors are in their closed position, said plunger bracket selectively movable between a retracted position wherein said plunger arms are disposed within the top lintel and an extended position wherein said plunger arms extend from the top lintel into the doors to engage said lock bars;

means for pivotably moving said plunger bracket from said retracted position to said extended position, said plunger arms engaging said lock bars to move said lock bars from said retracted position to said extended position; and means for biasing said plunger bracket and said lock bars towards said retracted positions.

12. The locking system as defined in claim 11 wherein said means for pivotably moving said plunger bracket comprises a longitudinally movable push bar attached to said plunger bracket, said push bar being movably retained by a mounting bracket connected to the cabinet frame within the top lintel.

13. The locking system as defined in claim 12 wherein said push bar is connected to manually engageable lock means, said lock means extending exteriorly of the top lintel and selectively movable between a disengaged position whereby said plunger bracket and lock bars are in their retracted positions and an engaged position whereby said plunger bracket and lock bars are in their extended positions.

14. The locking system as defined in claim 12 wherein said plunger bracket includes a pivot bar rotatably captured by said mounting bracket, said plunger arms extending substantially perpendicular from the ends of said pivot bar, and a bail member extending substantially perpendicular to said pivot bar, said bail member attached to said push bar, said plunger bracket pivoting about said pivot bar.

15. The locking system as defined in claim 12 wherein said means for biasing said plunger bracket and said lock bars comprises an extension spring connected at one end to said plunger bracket and at the other end to said mounting bracket and a compression spring mounted to each lock bar, said extension spring pivotably biasing said plunger bracket to retract said plunger arms from the doors and said compression springs biasing said lock bars upwardly to retract said lock bars from the bottom lintel.

16. A locking system for a cabinet having a pair of doors movable between an open position and a closed position, the cabinet including a frame with a top lintel disposed above the doors in their closed position and a bottom lintel disposed below the doors in their closed position, said locking system comprising:

a pair of elongated lock bars, one of said lock bars movably disposed within each door, said lock bars selectively movable between a retracted position wherein said lock bars are disposed within the doors and an extended position wherein said lock bars extend from the doors into the bottom lintel to prevent movement of the doors, said lock bars including means for biasing said lock bars to said retracted position;

a plunger bracket pivotably attached to the cabinet frame, said plunger bracket including a pair of plunger arms and a bail member, each of said plunger arms being engageable with one of said lock bars in the doors, said plunger bracket selectively movable between a retracted position and an extended position wherein said plunger arms extend from the top lintel into the doors to engage said lock bars, said plunger bracket including means for biasing said plunger bracket to said retracted position;

a push bar movably mounted to the cabinet frame, said push bar including means for engaging said bail member of said plunger bracket such that said plunger bracket is pivoted as said push bar is moved laterally; and manually engageable lock means connected to said push bar for locking and unlocking the cabinet doors.

17. The locking system as defined in claim 16 wherein said push bar is mounted to a mounting bracket, said mounting bracket attached to the cabinet frame within the top lintel thereof, said mounting bracket including at least two aligned slots adapted to slidably receive said push bar.

18. The locking system as defined in claim 17 wherein said means for biasing said plunger bracket includes an extension spring connected at a first end to said mounting bracket and at a second end to said bail member of said plunger bracket.

19. The locking system as defined in claim 16 wherein said means for biasing said lock bars includes a compression spring mounted to each lock bar, said spring disposed between said lock bar and the bottom of the door to bias said look bars upwardly away from the bottom lintel.

20. The locking system as defined in claim 16 wherein said plunger arms include plunger flanges formed at an angle to said arms at the remote end thereof, said plunger flanges extending downwardly from the top lintel into the doors to engage an upper end of said lock bars as said plunger bracket pivots towards the extended position thereby moving said lock bars to the extended position.

* * * * *